US011173708B2

(12) United States Patent
Martin et al.

(10) Patent No.: US 11,173,708 B2
(45) Date of Patent: Nov. 16, 2021

(54) FLUIDIC DIE WITH MONITORING CIRCUIT FAULT PROTECTION

(71) Applicant: Hewlett-Packard Development Company, L.P., Spring, TX (US)

(72) Inventors: Eric Martin, Corvallis, OR (US); Terry McMahon, Corvallis, OR (US); Donald W. Schulte, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/045,512

(22) PCT Filed: May 15, 2018

(86) PCT No.: PCT/US2018/032761
§ 371 (c)(1),
(2) Date: Oct. 6, 2020

(87) PCT Pub. No.: WO2019/221705
PCT Pub. Date: Nov. 21, 2019

(65) Prior Publication Data

US 2021/0162741 A1 Jun. 3, 2021

(51) Int. Cl.
*B41J 2/045* (2006.01)
*B41J 2/14* (2006.01)

(52) U.S. Cl.
CPC ..... *B41J 2/04548* (2013.01); *B41J 2/0451* (2013.01); *B41J 2/04541* (2013.01); *B41J 2/04555* (2013.01); *B41J 2/14153* (2013.01)

(58) Field of Classification Search
CPC .. B41J 2/04548; B41J 2/0451; B41J 2/04541; B41J 2/04555; B41J 2/14153
See application file for complete search history.

(56) References Cited

U.S. PATENT DOCUMENTS

| | | | |
|---|---|---|---|
| 8,573,750 | B2 | 11/2013 | Hoisington et al. |
| 10,730,294 | B2 * | 8/2020 | Funabashi ..... B41J 2/1642 |
| 2006/0092196 | A1 | 5/2006 | Iwao et al. |
| 2010/0117190 | A1 | 5/2010 | Chuang et al. |

(Continued)

FOREIGN PATENT DOCUMENTS

| | | |
|---|---|---|
| EP | 1288991 | 3/2003 |
| KR | 20030047331 | 6/2003 |

*Primary Examiner* — Geoffrey S Mruk
(74) *Attorney, Agent, or Firm* — Dicke Billig & Czaja PLLC

(57) ABSTRACT

A fluidic die includes a plurality of fluid chambers, each fluid chamber including an electrode exposed to an interior of the fluid chamber and having a corresponding fluid actuator operating a high voltage separated from the fluid chamber and electrode by an insulating material, and monitoring circuitry, operating at a low voltage, to monitor a condition of each fluid chamber. For each fluid chamber the monitoring circuitry includes a sense node and a conductor connecting the electrode to the sense node, the conductor having a geometry to form at least one region of higher current density relative to remaining portions of the conductor, the at least one region of higher current density to fail and create an open to protect the low-voltage monitoring circuitry in response to a fault current caused by a short circuit of the high voltage fluid actuator to the electrode.

15 Claims, 6 Drawing Sheets

(56) References Cited

U.S. PATENT DOCUMENTS

| | | | |
|---|---|---|---|
| 2014/0204148 | A1 | 7/2014 | Ge et al. |
| 2015/0245469 | A1 | 8/2015 | Hanazaki |
| 2017/0173969 | A1 | 6/2017 | Ge et al. |

* cited by examiner

FLUIDIC DIE WITH MONITORING CIRCUIT FAULT PROTECTION

BACKGROUND

Fluidic dies may include an array of nozzles and/or pumps each including a fluid chamber and a fluid actuator, where the fluid actuator may be actuated to cause displacement of fluid within the chamber. Some example fluidic dies may be printheads, where the fluid may correspond to ink.

Figure 1:
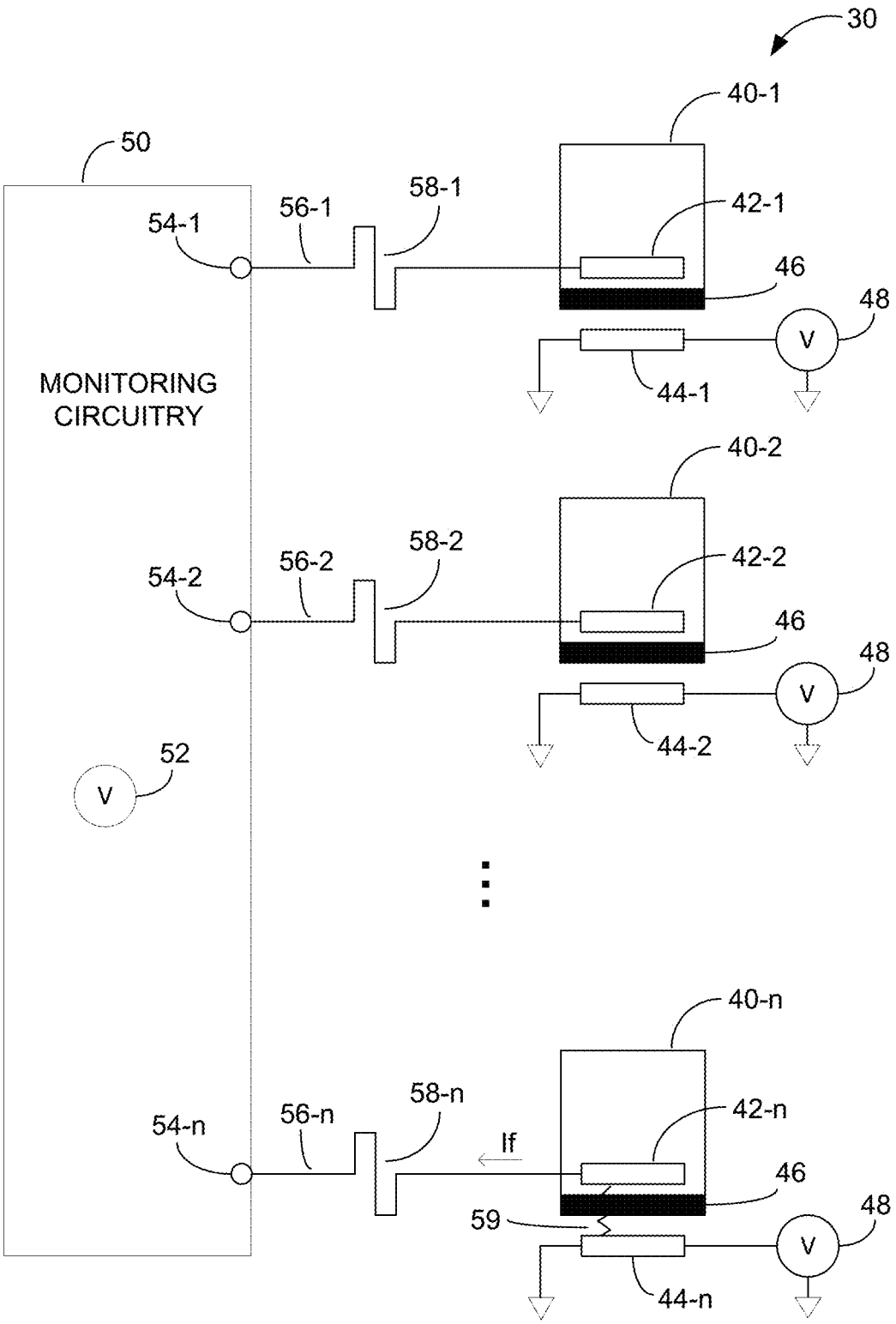
FIG. 1 is a block and schematic diagram illustrating a fluidic die, according to one example.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Examples of fluidic dies may include fluid actuators. The fluid actuators may include thermal resistor based actuators, piezoelectric membrane based actuators, electrostatic membrane actuators, mechanical/impact driven membrane actuators, magneto-strictive drive actuators, or other suitable devices that may cause displacement of fluid in response to electrical actuation. Fluidic dies described herein may include a plurality of fluid actuators, which may be referred to as an array of fluid actuators. An actuation event or firing event, as used herein, may refer to singular or concurrent actuation of fluid actuators of the fluidic die to cause fluid displacement.

In example fluidic dies, the array of fluid actuators may be arranged in sets of fluid actuators, where each such set of fluid actuators may be referred to as a "primitive" or a "firing primitive." The number of fluid actuators in a primitive may be referred to as a size of the primitive. The set of fluid actuators of a primitive generally have a set of actuation addresses with each fluid actuator corresponding to a different actuation address of the set of actuation addresses. In some examples, electrical and fluidic constraints of a fluidic die may limit which fluid actuators of each primitive may be actuated concurrently for a given actuation event. Primitives facilitate addressing and subsequent actuation of fluid actuator subsets that may be concurrently actuated for a given actuation event to conform to such constraints.

To illustrate by way of example, if a fluidic die comprises four primitives, with each primitive including eight fluid actuators (with each fluid actuator corresponding to different one of the addresses 0 to 7), and where electrical and fluidic constraints limit actuation to one fluid actuator per primitive, a total of four fluid actuators (one from each primitive) may be concurrently actuated for a given actuation event. For example, for a first actuation event, the respective fluid actuator of each primitive corresponding to address "0" may be actuated. For a second actuation event, the respective fluid actuator of each primitive corresponding to address "5" may be actuated. As will be appreciated, the example is provided merely for illustration purposes, such that fluidic dies contemplated herein may comprise more or fewer fluid actuators per primitive and more or fewer primitives per die.

Example fluidic dies may include fluid chambers, orifices, and/or other features which may be defined by surfaces fabricated in a substrate of the fluidic die by etching, microfabrication (e.g., photolithography), micromachining processes, or other suitable processes or combinations thereof. Some example substrates may include silicon based substrates, glass based substrates, gallium arsenide based substrates, and/or other such suitable types of substrates for microfabricated devices and structures. As used herein, fluid chambers may include ejection chambers in fluidic communication with nozzle orifices from which fluid may be ejected, and fluidic channels through which fluid may be conveyed. In some examples, fluidic channels may be microfluidic channels where, as used herein, a microfluidic channel may correspond to a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.).

In some examples, a fluid actuator may be arranged as part of a nozzle where, in addition to the fluid actuator, the nozzle includes an ejection chamber in fluidic communication with a nozzle orifice. The fluid actuator is positioned relative to the fluid chamber such that actuation of the fluid actuator causes displacement of fluid within the fluid chamber that may cause ejection of a fluid drop from the fluid chamber via the nozzle orifice. Accordingly, a fluid actuator arranged as part of a nozzle may sometimes be referred to as a fluid ejector or an ejecting actuator.

In one example nozzle, the fluid actuator comprises a thermal actuator which is spaced from the fluid chamber by an insulating layer, where actuation (sometimes referred to as "firing") of the fluid actuator heats the fluid to form a gaseous drive bubble within the fluid chamber that may cause a fluid drop to be ejected from the nozzle orifice, after which the drive bubble collapses. In some examples, a cavitation plate is disposed within the fluid chamber so as to be above the fluid actuator and in contact with the fluid within the chamber, where the cavitation plate protects material underlying the fluid chamber, including the underlying insulating material and fluid actuator, from cavitation forces resulting from generation and collapse of the drive bubble. In examples, the cavitation plate may be metal (e.g., tantalum).

In some examples, a fluid actuator may be arranged as part of a pump where, in addition to the fluidic actuator, the pump includes a fluidic channel. The fluidic actuator is positioned relative to a fluidic channel such that actuation of the fluid actuator generates fluid displacement in the fluid channel (e.g., a microfluidic channel) to convey fluid within the fluidic die, such as between a fluid supply (e.g., fluid slot) and a nozzle, for instance. A fluid actuator arranged to convey fluid within a fluidic channel may sometimes be referred to as a non-ejecting actuator. In some examples, similar to that described above with respect to a nozzle, a metal cavitation plate may be disposed within the fluidic channel above the fluid actuator to protect the fluidic actuator and underlying materials from cavitation forces resulting from generation and collapse of drive bubbles within the fluidic channel.

Fluidic dies may include an array of fluid actuators (such as columns of fluid actuators), where the fluid actuators of the array may be arranged as fluid ejectors (i.e., having corresponding fluid ejection chambers with nozzle orifices) and/or pumps (having corresponding fluid channels), with selective operation of fluid ejectors causing fluid drop ejection and selective operation of pumps causing fluid displacement within the fluidic die. In some examples, the array of fluid actuators may be arranged into primitives.

During operation of the fluidic die, conditions may arise that adversely affect the ability of nozzles to properly eject fluid drops and pumps to properly convey fluid within the die. For example, a blockage may occur in a nozzle orifice, ejection chamber, or fluidic channel, fluid (or components thereof) may become solidified on surfaces within a fluid chamber, such as on a cavitation plate, or a fluid actuator may not be functioning properly.

To determine when such conditions are present, techniques have been developed to measure various operating parameters (e.g., impedance, resistance, current, voltage) of nozzles and pumps using a sense electrode which is disposed so as to be exposed to an interior of the fluid chamber. In one case, in addition to protecting fluid actuators and other elements from cavitation forces, cavitation plates may also serve as sense electrodes. In one example, the sense electrode may be used to measure an impedance of fluid within the chamber when the nozzle and/or pump is inactive (i.e., not being fired), where such impedance may be correlated to a temperature of the fluid, fluid composition, particle concentration, and a presence of air, among others, for instance.

Drive bubble detect (DBD) is one technique which measures parameters indicative of the formation of a drive bubble within a fluid chamber to determine whether a nozzle or pump is defective (i.e. not operating properly). In one example, for a given fluid chamber, during an actuation event, a high-voltage (e.g., 15 V) is applied to the corresponding fluid actuator to vaporize at least one component of fluid (e.g., water) to form a drive bubble within the fluid chamber. In one example, at one or more selected times after commencement of the firing event (e.g., after expected formation but before collapse of the drive bubble), low-voltage (e.g., 5 V) DBD monitoring circuitry of the fluidic die selectively couples to the cavitation plate within the fluid chamber. In one example, the DBD monitoring circuitry provides a current pulse to the electrically conductive cavitation plate which flows through an impedance path formed by fluid and/or gaseous material of the drive bubble within the ejection chamber to a ground point. The low-voltage DBD circuit measures a voltage on the cavitation plate, with the voltage being indicative of the operating condition of the nozzle or pump (e.g., the nozzle/pump is operating properly, a nozzle orifice is plugged, etc.).

In example arrangements, the cavitation plate (or other electrode within the fluid chamber) is connected by a sense conductor to a sense node, where the DBD monitoring circuitry may selectively couple to the cavitation plate by selectively coupling to the sense node. In examples, the DBD monitoring circuitry may selectively couple to the sense node via at least one controllable switch (e.g., nFET, pFET, etc.), where the DBD monitoring circuitry is coupled to the sense node during a sense operation, but is otherwise disconnected there from (e.g., controllable switch in an open position).

In examples, at least portions of the DBD monitoring circuitry, including portions coupled to the sense node, operate at a low voltage level (e.g., 5 V) relative to a high voltage level (e.g., 15 V) at which fluid actuators operate. Although DBD monitoring circuitry is disconnected from sense nodes while a high voltage is being applied to fluid actuators during firing events, DBD monitoring circuitry may be damaged by overvoltage conditions even when disconnected from a sense node if a fluid actuator short circuits to a cavitation plate such that the higher operating voltage of the fluid actuator is present on the sense node. Since DBD monitoring circuitry is typically implemented to minimize a required amount of already limited silicon area on a fluidic die, such damage may not only prevent the ability of DBD monitoring circuitry to monitor the nozzle or pump in which the fluid actuator short occurred, but may also prevent the DBD monitoring circuitry from monitoring other nozzles and/or pumps as well.

FIG. 1 is a block and schematic diagram generally illustrating a fluidic die 30 having monitoring circuitry, such as DBD monitoring circuitry, including a conductor to connect an electrode within a fluid chamber (e.g., a cavitation plate) to a sense node of the monitoring circuitry, the conductor having a geometry to form at least one region of higher current density relative to remaining portions of the conductor, the at least one region of higher current density to fail and create an open to protect the low-voltage monitoring circuitry in response to a fault current caused by a high voltage being present on the conductor due to a short circuit between the cavitation plate and a corresponding high voltage fluid actuator, according to one example of the present disclosure.

In one example, fluidic die 30 includes a plurality of fluid chambers 40 (illustrated as fluid chambers 40-1 to **40-*n*), with each chamber including an electrode 42 (illustrated as electrodes 42-1 to 42-*n*) disposed therein. In one example, electrode 42 comprises a cavitation plate 42 disposed at a bottom of fluid chamber 40. Each fluid chamber 42 has a corresponding fluid actuator 44 (illustrated as fluid actuators 44-1 to 44-*n*) which is separated from the fluid chamber 40 and electrode 42, such as by an insulating material 46 (e.g., an oxide layer). In one example, fluid actuators 44 operate at a high voltage 48 (e.g., 15 volts) and when actuated may cause vaporization of fluid within fluid chamber 40 to form a drive bubble therein. In a case where fluid chamber 40 is a nozzle, formation of a drive bubble via actuation of fluid actuator 44 may cause ejection of a fluid drop (e.g., ink) from a nozzle orifice. In a case where fluid chamber 40 is a pump, formation of a drive bubble via actuation of fluid actuator 44 may cause conveyance of fluid within fluidic die 30** (e.g., to/from a nozzle).

In one example, fluidic die 30 includes monitoring circuitry 50 for monitoring an operating condition of the plurality of fluid chambers 40, where monitoring circuitry 50 operates at a low voltage 52 (e.g., 5 V) relative to the high voltage 48 at which fluid actuators 44 operate. In one case, monitoring circuitry 50 may comprise DBD monitoring circuitry. According to one case, for each fluid chamber 40, monitoring circuitry 50 includes a sense node 54 (illustrated as sense nodes 54-1 to **54-*n*) which is electrically connected to cavitation plate 42 of the corresponding fluid chamber 40 by a conductor 56 (illustrated as conductors 56-1 to 56-*n***).

According to examples which will be described in greater detail herein, conductor 56 has a geometry to form at least one region of high current density 58 (illustrated by a zig-zag line) relative to remaining portions of conductor 56, where the at least one region of high current density 58 is to fail and create an open in conductor 56 in response to a fault current ($I_f$) caused by high voltage 48 being present on conductor 56 due to a short circuit 59 between fluid actuator 44 and cavitation plate 42, such as illustrated with respect to fluid chamber **40-*n*. By creating an open in response to fault current, $I_f$, conductor 56 protects low-voltage monitoring circuitry 50 from damage that may otherwise be caused by a short circuit between a fluid actuator 44 and a cavitation plate 42**.

Figure 2:
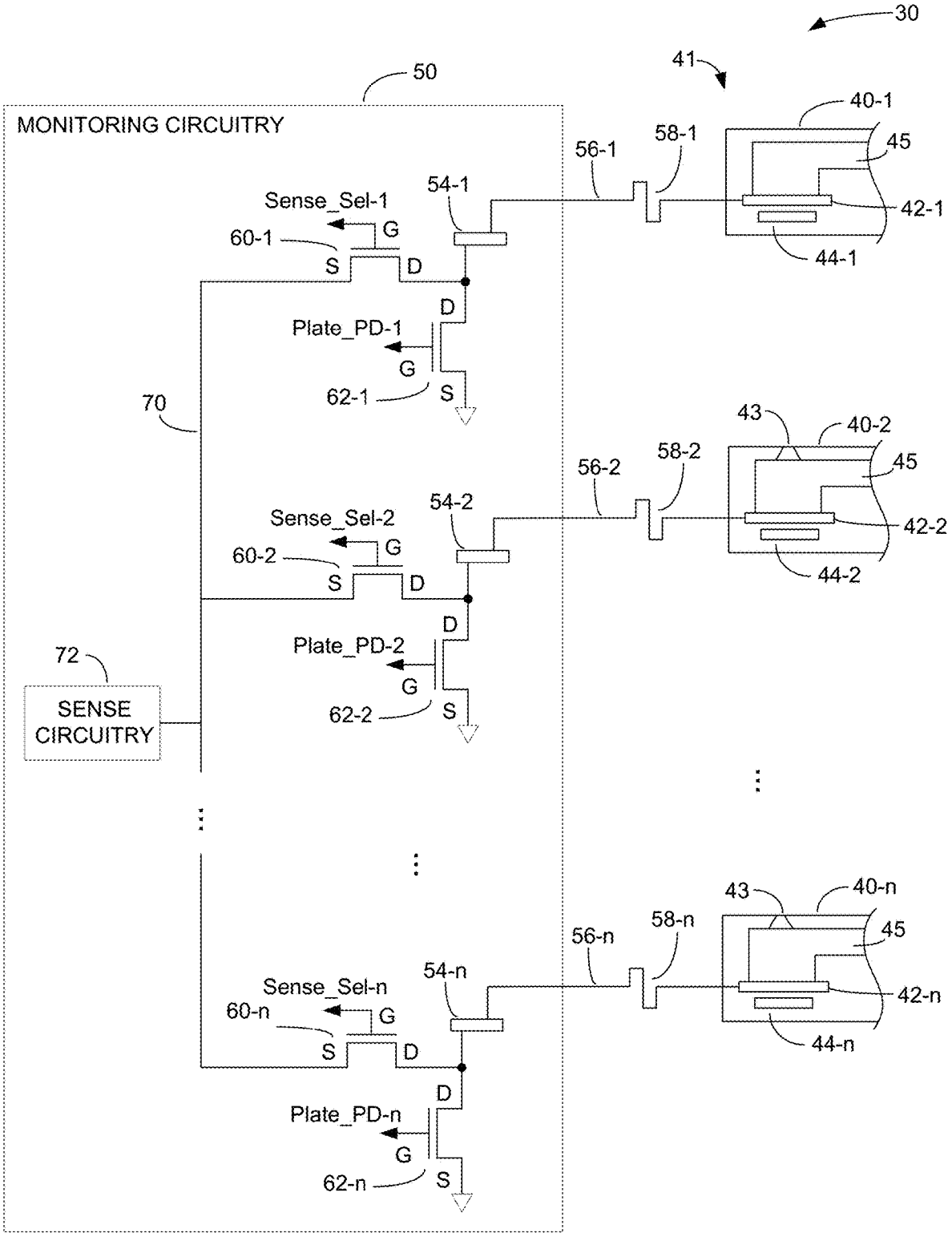
FIG. 2 is a block and schematic diagram illustrating a fluidic die, according to one example.

FIG. 2 is a block and schematic diagram generally illustrating portions of a fluidic die 30 according to one example. In one example, the plurality of fluid actuators 44 is arranged to form a primitive 41, with some of the fluid actuators 44 are arranged as part of a nozzle where the corresponding fluid chambers 40 are in fluidic communication with a nozzle orifice 43 (such as illustrated by fluid chambers 40-2 and **40-*n*, for instance), and some are arranged as part of a pump (such illustrated by fluid chamber 40-1, for instance). In one example, each cavitation plate 42 is disposed within the corresponding fluid chamber 40 so as to be exposed to an interior thereof and which may be in contact with a fluid 45** which may be present therein (e.g., ink).

In one example, in addition to sense node 54, for each fluid chamber 40, monitoring circuitry 50 includes a select switch 60 (illustrated as select switches 60-1 to **60-*n*) and a pulldown switch 62 (illustrated at pulldown switches 62-1 to 62-*n*) connected to the corresponding sense node 54. In one example, each select switch 60 and pulldown switch 62 is a transistor. In one example, each select switch 60 is a MOS FET (e.g., NMOS, PMOS) having one of a drain and a source connected to the corresponding sense node 54**.

In one example arrangement, as illustrated, each select switch 60 and pulldown switch 62 is an NMOS FET having a gate (G), source (S) and drain (D), with the drain each select FET 60 and pulldown FET 62 coupled to the corresponding sense node 54, the source of each select FET 60 is coupled to a sense line 70 which, in-turn, is connected to sense circuitry 72, and the source of each pulldown FET 62 coupled to a reference voltage (e.g., a 0V reference or ground). Monitor circuitry 50 provides a sense select signal (Sense_Sel) to the gate of each select FET 60 (illustrated as sense select signals Sense_Sel-1 to Sense_Sel-*n*) and provides a plate pulldown signal (Plate_PD) to the gate of each pulldown FET 62 (illustrated as plate pulldown signals Plate_PD-1 to Plate_PD-*n*).

In one example, during normal firing events of fluid actuators 44, monitoring circuitry 50, via the Plate_PD signals, maintains pulldown FETs 62 in an enabled state (e.g., a closed position) so as to maintain cavitation plates 42 at a "safe" voltage (e.g., ground), and maintains select FETs 60 in a disabled state (e.g., an open position) to as to isolate monitoring circuitry 50, including sense circuitry 72, from cavitation plates 42. During a sensing operation, monitoring circuitry 50 connects the cavitation plate 42 of only one fluid chamber 40 at a time to sense circuitry 72 by enabling the select FET 60 of the selected fluid chamber 40 via the Sense_Sel signals and by disabling the corresponding pulldown FET 62. As described above, in one example, sense circuitry 72 provides a sense current (e.g., a current pulse) through fluid 45 and/or vaporized portions of fluid 45 within the selected fluid chamber 40 via sense line 70 and the corresponding select FET 60, sense node 54, plate conductor 56, and cavitation plate 42. Sense circuitry 72 monitors a resulting voltage on sense line 70 to evaluate an operating condition of the selected fluid chamber 40.

Figure 3:
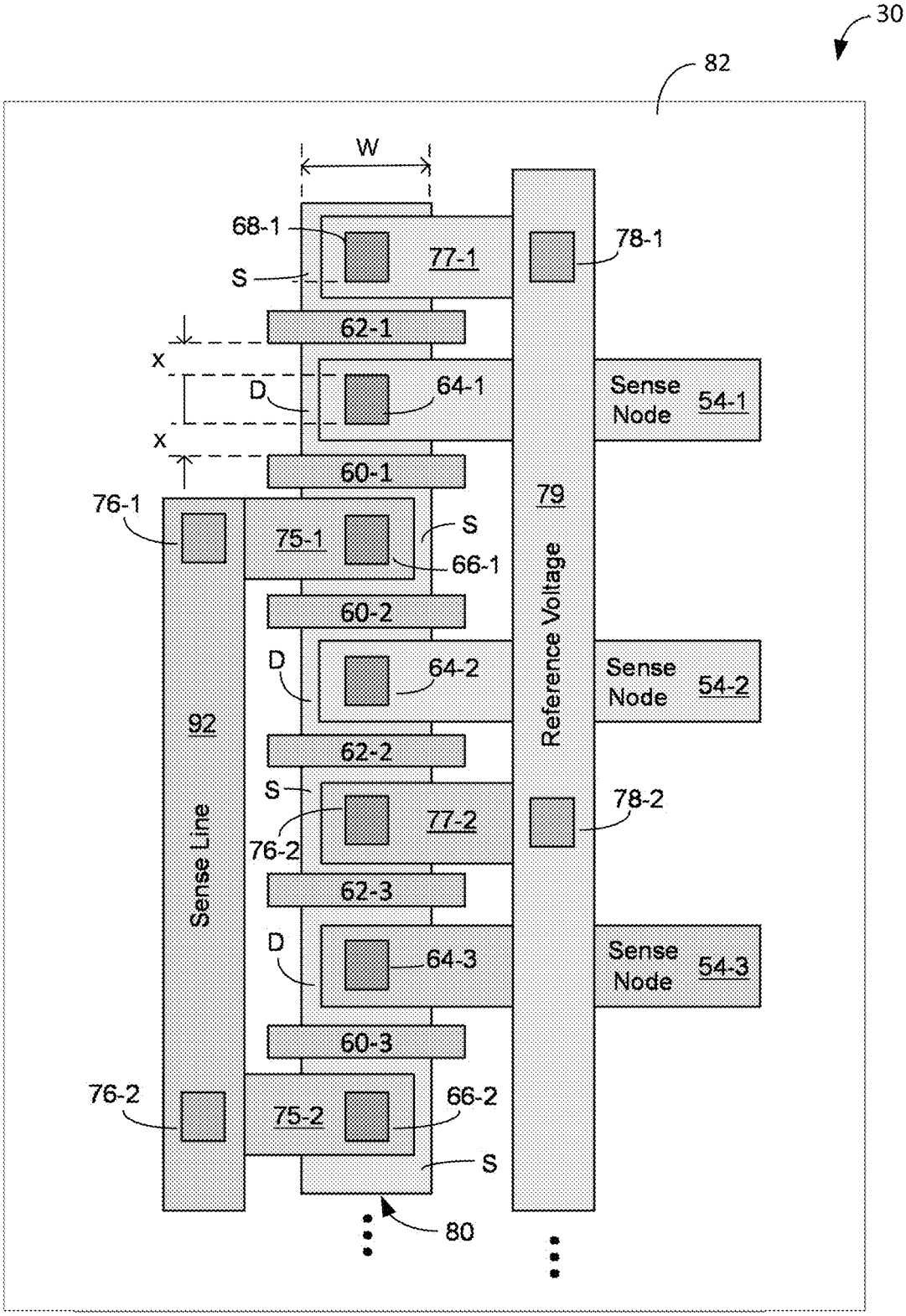
FIG. 3 is a block and schematic diagram illustrating a plan view of a wiring layout of a fluidic die, according to one example.

FIG. 3 is a plan view illustrating a simplified wiring and device layout of a portion of fluidic die 30 of FIG. 2, according to one example. Gates of select and pulldown FETs (e.g., polysilicon material) are illustrated at 60-1 to 60-3 and 62-1 to 62-3 as being positioned over active source and drain regions 80 in a substrate 82 of fluidic die 30, with the active regions alternating as source and drain regions (indicated as "S" and "D"). In a case of select and pulldown FETs 60 and 62 being NMOS FETs, source and drain regions 80 comprise n-doped regions within a p-type substrate 82. Conventionally, source and drain regions 80 are arranged in a column having a width (W) defined by a gate width of select and pulldown FETs 60 and 62.

With area on fluidic die 30 being limited, to save space, monitoring circuitry 50, including sense circuitry 72, is shared between fluid chambers 40 of primitive 41, with only one cavitation plate 42 of a selected fluid chamber 40 being coupled to sense circuitry 72 at a time via control of select and pulldown FETs 60 and 62. Additionally, because sense and pulldown FETs 60 and 62 are instantiated in a region of high circuit density on fluidic die 30, in some cases, adjacent sense and pulldown FETs 60 and 62 may share drain and source regions 80 and corresponding drain and source contacts to minimize required circuit space.

For instance, as illustrated in FIG. 3, the pair of sense and pulldown FETs 60 and 62 for each fluid chamber 40 share a drain region "D" and drain contract 64, with the shared drain contact 64 being connected to a corresponding sense node 54. Typically, in order to minimize space requirements, a dimension "x" between a gate and contact, such as between gate 62-1 and source contact 68-1, for example, is minimized based on process limitations.

In another example, pairs of select FETs 60 of adjacent fluid chambers 40 share a source region "S" and a source contact 66, with the shared source contact 66 being connected to sense line 70 by a corresponding sense line node 69 and via 76. In one example, pairs of pulldown FETs 62 of adjacent fluid chambers 40 share a source region "S" and a source contact 68, with the shared source contract 68 being connected to a ground line 74 by a correspond ground node 77 and via 78, such as illustrated by pulldown FETs 62-2 and 62-3, respectively corresponding to fluid chambers 40-2 and 40-3, sharing a source region "S" and source contact 68-2 and being connected to ground line 74 by ground node 77-2 and via 78-2. In one example, as described below, sense nodes 54, sense line nodes 75, and ground nodes 77 are arranged in a Metal1 layer, and sense line 70 and ground line 74 are arranged in a Metal2 layer of fluidic die 30.

Figure 4:
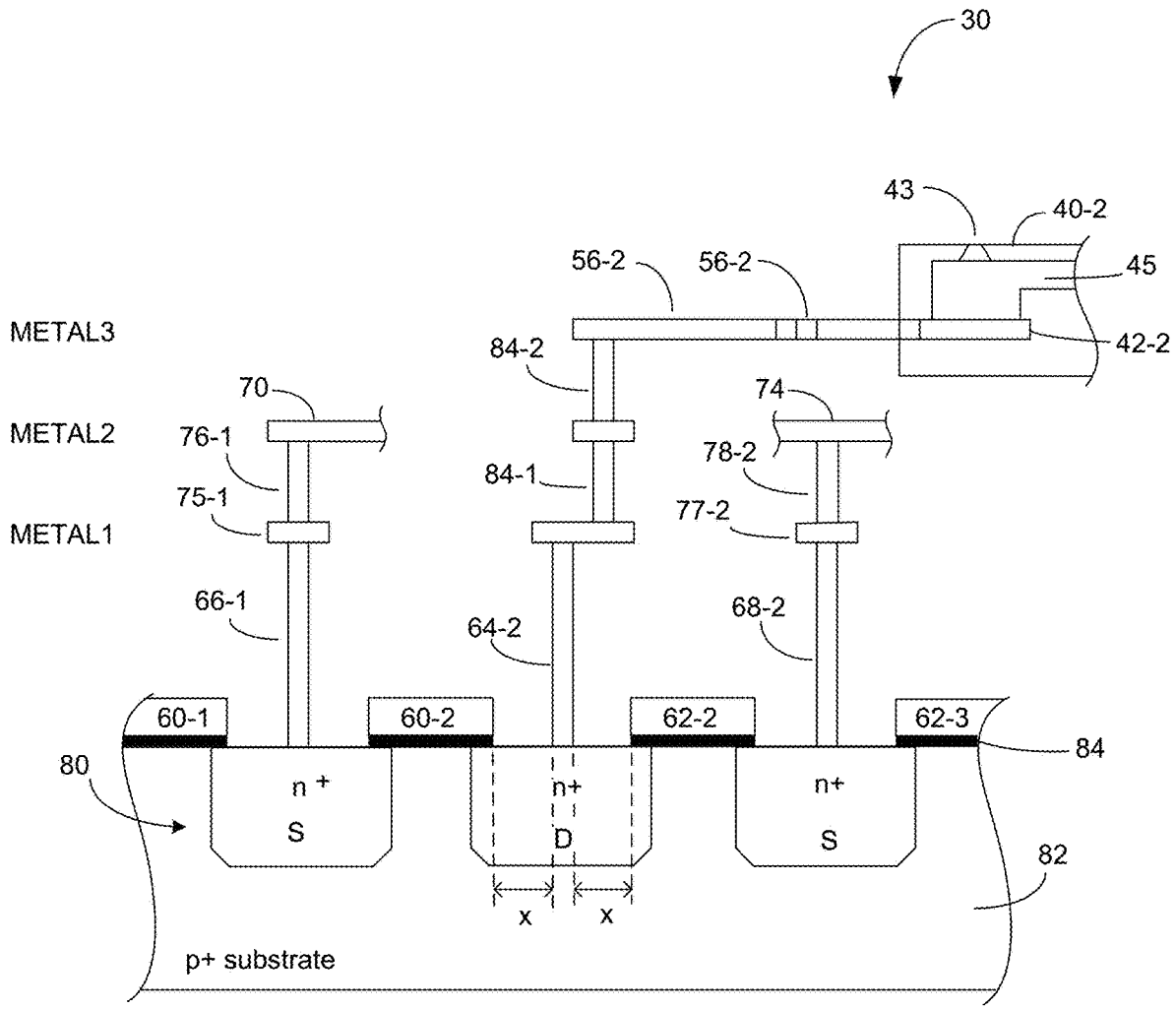
FIG. 4 is a block and schematic diagram illustrating cross-sectional view of a wiring layout of a fluidic die, according to one example

FIG. 4 is a cross-sectional view generally illustrating a simplified layout of a portion of fluidic die 30 of FIG. 3, according to one example. Polysilicon gates of select switches 60-1 and 60-2, and pulldown switches 62-2 and 62-3 are illustrated as being disposed on corresponding gate oxide layers 84. Select FETs 60-1 and 60-2 share a source region "S" and source contact 66-1, with source contact 66-1 being connected to sense line 70 by sense line node 75-1 and via 76-1. Pulldown FETs 62-2 and 62-3 share a source region "S" and source contact 68-2, with source contact 68-2 being connected to ground line 74 by ground node 77-2 and via 78-2.

Select FET 60-2 and pulldown FET 62-2 share a drain region "D" and drain contact 64-2, with drain contact 64-2 being connected to sense node 54-2. Sense node 54-2 connected to conductor 56-2 in metal3 through metal2 by vias 84-1 and 84-2. Conductor 56-2, including the at least one region of high current density 58, is connected to cavitation plate 42-2 of fluid chamber 40-2.

While a compact arrangement of sense and pulldown FETs 60 and 62, such as illustrated by the examples of FIGS. 3 and 4, reduces required circuit area for monitoring circuitry 50 on fluidic die 30, such a compact arrangement may be susceptible to damage from an overvoltage condition resulting from a short circuit of a fluid actuator 44 to a cavitation plate 42, even when monitoring circuitry 50 is decoupled from sense node 54 (i.e., when select FET 60 is "disabled"). For example, with select FETs 60 and pulldown FETs 62 sharing a drain region and drain contact 64, a high voltage on a sense node 54 resulting from a short circuit of a fluid actuator 44 to a cavitation plate 42 of the corresponding fluid chamber 40 may result in a high voltage and fault current at the shared drain contact 64 that could damage the gate poly of both select FET 60 and pulldown FET 62. For instance, select FET 60-1 and pulldown FET 62-1 corresponding to fluid chamber 40-1 may be damaged if fluid actuator 44-1 shorts to cavitation plate 42-1 and places a high voltage on shared drain contact 64-1 via conductor 56-1 and sense node 54-1. If select FET 60-1 is damaged and unable to isolate sense circuitry 72 from sense node 54-1, monitoring circuitry 50 will be unable to perform monitoring of remaining operational fluid chambers 40 of primitive 41.

Due to the compact structure, such a fault could also potentially compromise the gate structure of a select FET 60 and damage a shared source contact 66 and sense line node 75. For instance, a high voltage on sense node 54-1 may compromise the gate of select switch 60-2 and damage shared source contact 66-1 and sense line node 75-1. Again, such damage may result in monitoring circuit 50 being unable to perform monitoring of the fluid chambers 40 of primitive 41 as a whole, and could potentially damage sense circuitry 72 (e.g., via sense line 70).

A high voltage on a drain contact 64 may also a fault current to flow through the corresponding drain region and potentially damage the underlying substrate, such as a fault current flowing into substrate 82 through the shared drain region of select FET 60-2 and pulldown FET 64-2 from shared drain contact 64-2.

According to examples, conductors 56 connecting cavitation plates 42 to sense nodes 54 have a geometry to form at least one region 58 of high current density that, in response to a fault current caused by a short-circuit of the corresponding fluid actuator 44 to corresponding cavitation plate 42, is to fail and create an open in conductor 56 to protect DBC monitoring circuitry 50 from being damaged by such fault currents.

Figure 5:
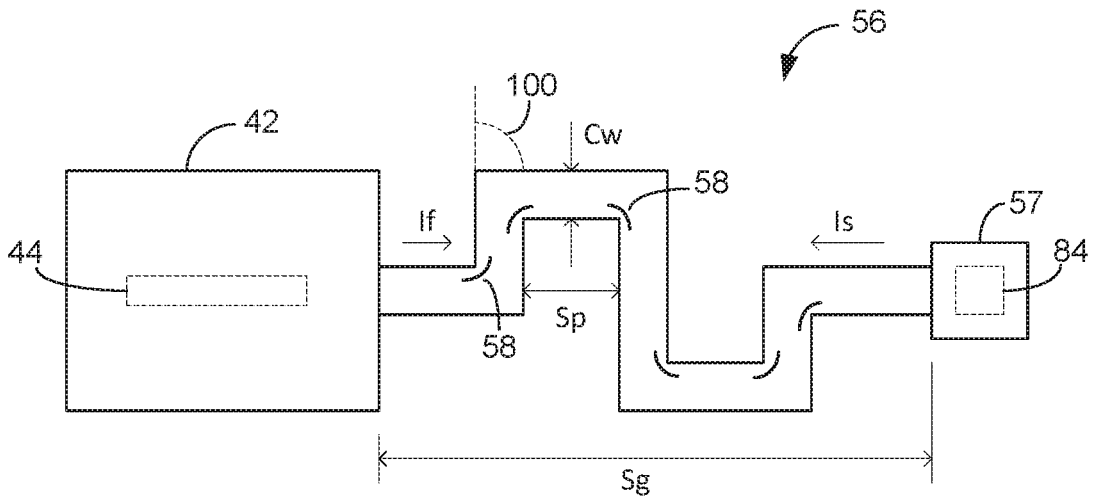
FIG. 5 is a block and schematic diagram generally illustrating a geometry of a conductor connecting a fluid chamber cavitation plate to a node, according to one example.

FIG. 5 is a plan view generally illustrating conductor 56, according to one example, which connects cavitation plate 42 to a contact pad 57 which, in-turn, is connected to sense node 54 by via 84 (see FIG. 4). According to one example, conductor 56, contact pad 57, and cavitation plate 42 comprise tantalum. Conductor 56 includes at least one region of higher current density 58 relative to remaining portions of the conductor, where the at least one region of higher current density 58 is to fail and create an open to protect monitoring circuitry 50 from potential damage in response to a fault current caused by a short circuit of high voltage fluid actuator 44 to cavitation plate 42.

According to one example, as illustrated, conductor 56 has a geometry including a series of 90-degree bends (indicated as 90-degree bend 100), where each 90-degree bend forms a region of high current density 58 along an inside portion of each 90-degree bend when current is flowing through conductor 56. Under normal operating conditions, when low voltage DBC monitoring circuit 50 injects a sense current ($I_s$) through cavitation plate 42 via conductor 56, a magnitude of current density in the regions of high current density 58 resulting from the sense current is less than a maximum current density (failure point) of conductor 56. However, under a fault condition, such as when fluid actuator 44 short circuits to cavitation plate 42, a magnitude of current density in the regions of high current density 58 resulting from the fault current (If) may exceed the maximum current density of conductor 56, causing a thermal failure and creating an open in conductor 56 at the region of high current density 58, where such opening protects monitoring circuitry 50 from potential damage that might otherwise be caused by such fault current.

In one example, a width ($C_w$) and a spacing (Sp) between segments of conductor 56 are minimized based on process limitations (e.g., design rules). In one instance, conductor 56 has geometry that includes at least one 90-degree bend to form at least one region of high current density 58 relative to remaining portions of conductor 56. In one example, for a given space or gap (Sg) between cavitation plate 42 and contact pad 57, a geometry of conductor 56 includes a maximum number of 90-degree bends based on process design rules so as to form a series of regions of high current density 58.

Figure 6:
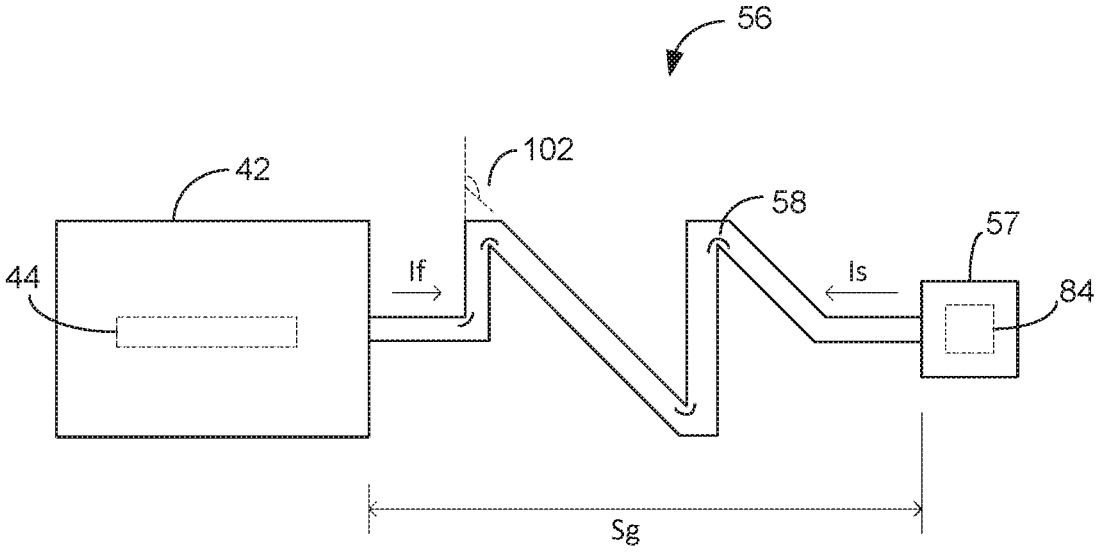
FIG. 6 is a block and schematic diagram generally illustrating a geometry of a conductor connecting a fluid chamber cavitation plate to a node, according to one example.

With reference to FIG. 6, according to one example, conductor 56 has a geometry including at least one bend 102 greater than 90-degrees to form a region of high current density 58, where the greater the angle of the bend the greater the current density of the region of high current density 58 relative to "straight" portions of conductor 56. In one instance, conductor 56 includes at least one bend having a bend angle 102 greater than 90-degrees, where a maximum bend angle is based on process limitations or parameters (e.g., design rules). According to one example, a geometry of conductor 56 includes a series of greater than 90-degree bends 102. In one instance, for a given space or gap (Sg) between cavitation plate 42 and contact pad 57, a geometry of conductor 56 includes a maximum number of greater than 90-degree bends based on process design rules so as to form a series of regions of high current density 58. In one example, conductor 56 has a geometry including a combination of 90-degree bends and greater than 90-degree bends to form a series of regions of high current density 58.

Figure 7:
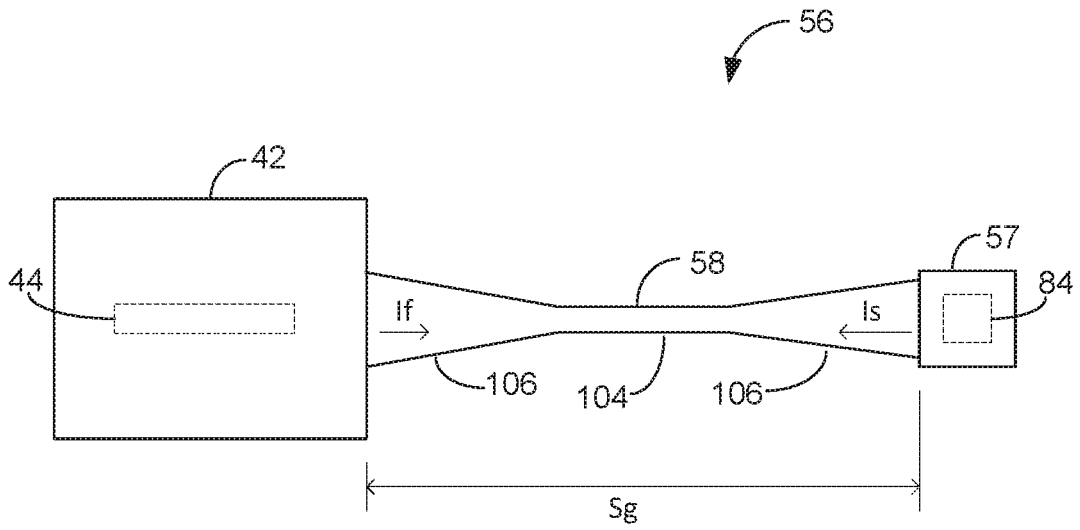
FIG. 7 is a block and schematic diagram generally illustrating a geometry of a conductor connecting a fluid chamber cavitation plate to a node, according to one example.

With reference to FIG. 7, according to one example, conductor 56 has a geometry including at least one region

104 having a smaller cross-sectional area relative to regions 106 having a greater cross-sectional area, where the at least one region 104 forms a region of high current density 58 relative to remaining portions of conductor 56. In one example (not illustrated), conductor 56 has geometry including a series of alternating regions of greater cross-sectional area 106 and smaller cross-sectional area 104 to form a series of regions of high current density 58. In one example, as illustrated, regions 106 of greater cross-sectional area have a tapered shape to transition to regions 104 of smaller cross-sectional area.

Figure 8:
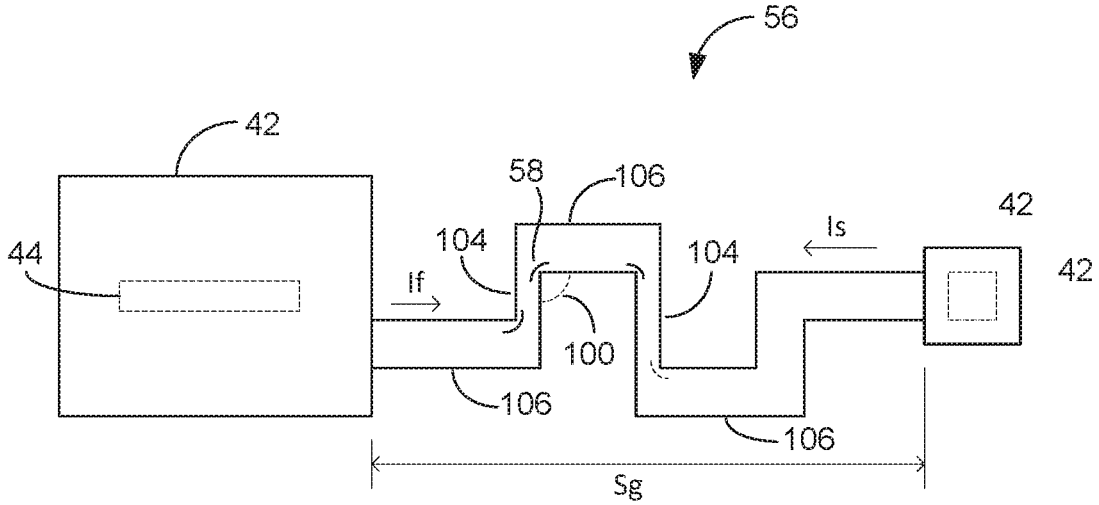
FIG. 8 is a block and schematic diagram generally illustrating a geometry of a conductor connecting a fluid chamber cavitation plate to a node, according to one example.

With reference to FIG. 8, according to one example, conductor 56 has a geometry including a combination of alternating regions of greater cross-sectional area 106 and smaller cross-sectional area 104 and a series of 90-degree bends 100, which together form a series of regions of high current density 58.

By providing conductors 56 having regions of high current density 58, fault protection is provided for low-voltage monitoring circuitry 50 without additional dedicated fault protection devices and without adjusting fabrication processes.

Although specific examples have been illustrated and described herein, a variety of alternate and/or equivalent implementations may be substituted for specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A fluidic die comprising:

a plurality of fluid chambers, each fluid chamber including an electrode exposed to an interior of the fluid chamber and having a corresponding fluid actuator, operating at a high voltage, separated from the fluid chamber and electrode by an insulating material; and monitoring circuitry, operating at a low voltage, to monitor a condition of each fluid chamber, for each fluid chamber the monitoring circuitry including:

a sense node; and a conductor connecting the electrode to the sense node, the conductor having a geometry to form at least one region of high current density relative to remaining portions of the conductor, the at least one region of higher current density to fail and create an open to protect the low-voltage monitoring circuitry in response to a fault current caused by a short circuit of the high voltage fluid actuator to the electrode.

2. The fluidic die of claim 1, the geometry includes at least one bend that forms the at least one region of high current density along an inside portion of the at least one bend.

3. The fluidic die of claim 2, the at least one bend having a bend angle of at least 90-degrees.

4. The fluidic die of claim 2, the geometry including a series of bends, each bend forming a corresponding region of high current density along an inside portion of the bend.

5. The fluidic die of claim 4, the geometry including bends having bend angles a range from 90-degrees to a maximum bend angle based on process design rules.

6. The fluidic die of claim 1, the geometry including at least one region of the conductor having a smaller cross-sectional area than remaining regions of the conductor having a greater cross-sectional area, the region of smaller cross-sectional area forming the at least one region of high current density.

7. The fluidic die of claim 6, the regions of greater cross-sectional area having a taper to transition to the at least one region of smaller cross-sectional area.

8. The fluidic die of claim 6, the geometry including a series of alternating regions of greater cross-sectional area and smaller cross-sectional area.

9. The fluidifc die of claim 1 including at least one bend that forms the at least one region of high current density along an inside portion of the at least one bend.

10. A fluidic die including:

a low-voltage node;

a fluid chamber having an electrode exposed to an interior of the fluid chamber;

a high voltage fluid actuator corresponding to the fluid chamber; and a conductor connecting the low-voltage node to the electrode, the conductor having geometry to form at least one region of high current density relative to remaining portions of the conductor, the at least one region of high current density to fail so to form an open in response to a short circuit of the high voltage fluid actuator to the electrode.

11. The fluidic die of claim 10, the electrode comprising a cavitation plate.

12. The fluidic die of claim 10, the geometry including a plurality of bends, with each bending forming a region of high current density along an inside portion of the bend.

13. The fluidic die of claim 12, each bending having a bend angle in a range from 90-degrees to a maximum bend angle based on process design rules.

14. The fluidic die of claim 10, the geometry including at least one region of the conductor having a smaller cross-sectional area than remaining regions of the conductor having a greater cross-sectional area, the region of smaller cross-sectional area forming the at least one region of high current density.

15. A fluidic die comprising:

low-voltage monitoring circuitry;

a fluid chamber including an electrode exposed to an interior of the fluid chamber and having a corresponding fluid actuator operating at a high voltage; and a conductor connecting the low-voltage monitoring circuitry to the electrode, the conductor having a geometry to form at least one region of high current density relative to remaining portions of the conductor, the at least one region of higher current density to fail and create an open in the conductor to protect the low-voltage monitoring circuitry from damage in response to a fault current caused by a short circuit of the high voltage fluid actuator to the electrode.

* * * * *